US009759425B2

(12) United States Patent
Westmoreland et al.

(10) Patent No.: US 9,759,425 B2
(45) Date of Patent: Sep. 12, 2017

(54) SYSTEM AND METHOD HAVING MULTI-TUBE FUEL NOZZLE WITH MULTIPLE FUEL INJECTORS

(71) Applicant: General Electric Company, Schenectady, NY (US)

(72) Inventors: James Harold Westmoreland, Greer, SC (US); Ronald James Chila, Greenfield Center, NY (US); Gregory Allen Boardman, Greer, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 870 days.

(21) Appl. No.: 13/798,027

(22) Filed: Mar. 12, 2013

(65) Prior Publication Data

US 2014/0338339 A1 Nov. 20, 2014

(51) Int. Cl.

| | |
|---|---|
| ***F23R 3/28*** | (2006.01) |
| ***F23D 14/62*** | (2006.01) |
| ***F23D 14/64*** | (2006.01) |
| ***F23R 3/12*** | (2006.01) |

(52) U.S. Cl.

CPC ..... *F23R 3/286* (2013.01); *F23D 14/62* (2013.01); *F23R 3/12* (2013.01); *F23D 14/64* (2013.01)

(58) Field of Classification Search

CPC ..... F23R 3/286; F23D 14/62; F23D 14/64

See application file for complete search history.

(56) References Cited

U.S. PATENT DOCUMENTS

| | | | | |
|---|---|---|---|---|
| 1,855,165 | A | | 4/1932 | Barker |
| 2,564,042 | A | | 8/1951 | Walker |
| 3,581,492 | A | | 6/1971 | Norgren et al. |
| 3,751,911 | A | | 8/1973 | De Tartaglia |
| 4,100,733 | A | | 7/1978 | Striebel et al. |
| 4,408,461 | A | | 10/1983 | Bruhwiler et al. |
| 4,587,809 | A | * | 5/1986 | Ohmori ..... B01F 5/0451 60/737 |
| 4,763,481 | A | | 8/1988 | Cannon |
| 4,796,429 | A | | 1/1989 | Verdouw |
| 5,121,597 | A | | 6/1992 | Urushidani et al. |
| 5,161,366 | A | | 11/1992 | Beebe |
| 5,235,814 | A | | 8/1993 | Leonard |
| 5,274,991 | A | | 1/1994 | Fitts |

(Continued)

OTHER PUBLICATIONS

U.S. Appl. No. 13/797,848, filed Mar. 12, 2013, Boardman et al.

(Continued)

*Primary Examiner* — Pascal M Bui Pho
*Assistant Examiner* — Eric Linderman
(74) *Attorney, Agent, or Firm* — Fletcher Yoder, P.C.

(57) ABSTRACT

A system includes a multi-tube fuel nozzle. The multi-tube fuel nozzle includes multiple fuel injectors. Each fuel injector is configured to extend into a respective premixing tube of a plurality of mixing tubes. Each fuel injector includes a body, a fuel passage, and multiple fuel ports. The fuel passage is disposed within the body and extends in a longitudinal direction within a portion of the body. The multiple fuel ports are disposed along the portion of the body and coupled to the fuel passage. A space is disposed between the portion of the body with the fuel ports and the respective premixing tube.

14 Claims, 11 Drawing Sheets

(56) References Cited

U.S. PATENT DOCUMENTS 5,361,586 A 11/1994 McWhirter et al.
5,410,884 A 5/1995 Fukue et al.
5,415,000 A 5/1995 Mumford et al.
5,515,680 A * 5/1996 Fujimura ..... B01F 5/0405 239/434
5,611,196 A * 3/1997 Wilson ..... F23R 3/286 60/39.11
5,675,971 A * 10/1997 Angel ..... F23R 3/286 239/405
5,778,676 A * 7/1998 Joshi ..... F23D 11/101 239/405
5,816,049 A 10/1998 Joshi
5,822,992 A * 10/1998 Dean ..... F23D 11/104 239/419.3
5,901,555 A 5/1999 Mandai et al.
5,927,076 A 7/1999 Pillsbury
5,943,866 A * 8/1999 Lovett ..... F23R 3/286 431/114
6,016,658 A 1/2000 Willis et al.
6,026,645 A * 2/2000 Stokes ..... F23D 14/62 239/419.5
6,038,861 A 3/2000 Amos et al.
6,092,363 A 7/2000 Ryan
6,164,055 A 12/2000 Lovett et al.
6,334,309 B1 * 1/2002 Dean ..... F23D 11/101 60/737
6,351,948 B1 3/2002 Goeddeke
6,360,776 B1 * 3/2002 McCormick ..... F23D 14/62 137/896
6,363,724 B1 4/2002 Bechtel et al.
6,438,959 B1 8/2002 Dean et al.
6,438,961 B2 8/2002 Tuthill et al.
6,530,222 B2 3/2003 Stuttaford et al.
6,532,742 B2 3/2003 Scarinci et al.
6,705,087 B1 3/2004 Ohri et al.
6,832,483 B2 12/2004 Moriya et al.
6,880,340 B2 4/2005 Saitoh
6,928,823 B2 * 8/2005 Inoue ..... F02C 7/22 60/737
6,983,600 B1 1/2006 Dinu et al.
7,007,478 B2 3/2006 Dinu
7,007,486 B2 3/2006 Sprouse et al.
7,021,562 B2 4/2006 Mansour et al.
7,134,287 B2 11/2006 Belsom et al.
7,171,813 B2 * 2/2007 Tanaka ..... F23R 3/343 431/174
7,181,916 B2 2/2007 Ziminsky et al.
7,284,378 B2 10/2007 Amond, III et al.
7,469,544 B2 * 12/2008 Farhangi ..... F23C 9/00 60/737
7,578,130 B1 8/2009 Kraemer et al.
7,617,682 B2 11/2009 Bruck
7,841,180 B2 11/2010 Kraemer et al.
7,841,182 B2 11/2010 Martin
7,900,456 B2 3/2011 Mao
8,065,880 B2 * 11/2011 Ishizaka ..... F23R 3/14 60/737
8,079,218 B2 12/2011 Widener
8,104,291 B2 1/2012 Myers et al.
8,122,721 B2 2/2012 Johnson et al.
8,205,452 B2 6/2012 Boardman et al.
8,234,871 B2 * 8/2012 Davis, Jr. ..... F23R 3/286 60/737
8,234,872 B2 * 8/2012 Berry ..... F23R 3/04 239/590.3
8,240,151 B2 8/2012 Pelletier et al.
8,266,912 B2 * 9/2012 Berry ..... F02C 7/28 277/647
8,276,385 B2 10/2012 Zuo et al.
8,322,143 B2 12/2012 Uhm et al.
8,327,642 B2 12/2012 Uhm et al.
8,402,763 B2 3/2013 Mulherin et al.
8,408,004 B2 4/2013 Davis, Jr. et al.
8,424,311 B2 4/2013 York et al.
8,438,853 B2 5/2013 Green et al.
8,474,265 B2 7/2013 Jain et al.
8,484,978 B2 7/2013 Bailey et al.
8,505,304 B2 * 8/2013 Myers ..... F23R 3/283 60/737
8,522,555 B2 9/2013 Berry et al.
8,528,334 B2 9/2013 Dutta et al.
8,528,336 B2 9/2013 Cihlar et al.
8,572,979 B2 11/2013 Smith et al.
8,701,419 B2 4/2014 Hughes
8,789,372 B2 7/2014 Johnson et al.
8,800,289 B2 8/2014 Johnson et al.
8,850,821 B2 10/2014 Khan et al.
8,899,049 B2 12/2014 Krull et al.
8,904,797 B2 12/2014 Berry et al.
8,938,978 B2 1/2015 Bailey et al.
9,032,704 B2 5/2015 Crothers et al.
9,151,502 B2 * 10/2015 Crothers ..... F02C 7/22
9,200,571 B2 12/2015 Bailey et al.
9,255,711 B2 2/2016 Crothers et al.
9,316,397 B2 4/2016 Stewart et al.
2001/0052229 A1 12/2001 Tuthill et al.
2002/0014078 A1 * 2/2002 Mandai ..... F23R 3/286 60/737
2002/0119412 A1 * 8/2002 Loving ..... F23D 14/64 431/252
2002/0128790 A1 9/2002 Woodmansee
2002/0192615 A1 * 12/2002 Moriya ..... F23D 14/02 431/278
2003/0014975 A1 * 1/2003 Nishida ..... F23R 3/002 60/737
2003/0037549 A1 2/2003 Mandai et al.
2003/0089801 A1 * 5/2003 Saitoh ..... F23R 3/286 239/533.1
2004/0006990 A1 * 1/2004 Stuttaford ..... F23R 3/286 60/776
2004/0006991 A1 * 1/2004 Stuttaford ..... F23R 3/36 60/776
2004/0006992 A1 * 1/2004 Stuttaford ..... F23R 3/286 60/776
2004/0006993 A1 * 1/2004 Stuttaford ..... F23R 3/36 60/776
2004/0060297 A1 * 4/2004 Koenig ..... F23R 3/286 60/737
2004/0142294 A1 * 7/2004 Niass ..... F23C 7/002 431/278
2004/0163392 A1 8/2004 Nishida et al.
2007/0289305 A1 * 12/2007 Oda ..... F23D 11/383 60/748
2008/0053097 A1 3/2008 Han et al.
2008/0078179 A1 * 4/2008 Cai ..... F23R 3/286 60/748
2008/0163627 A1 * 7/2008 ELKady ..... F23D 14/62 60/737
2009/0229269 A1 * 9/2009 Lacy ..... F23R 3/28 60/737
2009/0241547 A1 10/2009 Luts et al.
2009/0280443 A1 * 11/2009 Carroni ..... F23D 14/64 431/8
2010/0064691 A1 * 3/2010 Laster ..... F23R 3/286 60/737
2010/0089065 A1 4/2010 Tuthill
2010/0192579 A1 8/2010 Boardman et al.
2010/0192583 A1 8/2010 Wolff et al.
2010/0192586 A1 * 8/2010 Terada ..... F23D 14/78 60/742
2010/0205970 A1 8/2010 Hessler et al.
2010/0218501 A1 9/2010 York et al.
2010/0236252 A1 * 9/2010 Huth ..... F23R 3/14 60/772
2010/0263384 A1 10/2010 Chila
2011/0005230 A1 1/2011 Bailey et al.
2011/0016866 A1 * 1/2011 Boardman ..... F23R 3/36 60/730
2011/0016871 A1 * 1/2011 Kraemer ..... F23N 5/082 60/772

(56) References Cited

U.S. PATENT DOCUMENTS

2011/0107764 A1 5/2011 Bailey et al.
2011/0113783 A1* 5/2011 Boardman ..... F23C 13/06 60/723
2011/0197591 A1* 8/2011 Valeev ..... F23R 3/286 60/772
2011/0209481 A1 9/2011 Simmons
2011/0314823 A1 12/2011 Smith et al.
2012/0047902 A1 3/2012 Tuthill
2012/0055167 A1 3/2012 Johnson et al.
2012/0073302 A1* 3/2012 Myers ..... F23D 11/402 60/748
2012/0180487 A1* 7/2012 Uhm ..... F23D 14/62 60/737
2012/0180488 A1 7/2012 Bailey et al.
2012/0181354 A1* 7/2012 Bailey ..... B22D 25/00 239/403
2012/0227371 A1 9/2012 Johnson et al.
2012/0297785 A1* 11/2012 Melton ..... F23R 3/286 60/772
2012/0324896 A1* 12/2012 Kim ..... F23C 7/004 60/737
2013/0025285 A1 1/2013 Stewart et al.
2013/0067920 A1* 3/2013 Fox ..... F23R 3/14 60/738
2013/0074503 A1 3/2013 Rohrssen et al.
2013/0086912 A1 4/2013 Berry
2013/0104554 A1* 5/2013 Bode ..... F23R 3/343 60/740
2013/0125549 A1 5/2013 Bailey et al.
2013/0180256 A1 7/2013 Stoia
2013/0213051 A1 8/2013 Westmoreland, III et al.
2013/0232977 A1 9/2013 Siddagangaiah et al.
2013/0232979 A1 9/2013 Singh
2013/0241089 A1* 9/2013 Westmoreland ..... F23R 3/286 261/76
2013/0299602 A1 11/2013 Hughes et al.
2014/0033718 A1 2/2014 Manoharan et al.
2014/0033722 A1* 2/2014 Abdel-Hafez ..... F23C 7/004 60/737
2014/0109587 A1 4/2014 Crothers et al.
2014/0245738 A1 9/2014 Crothers et al.
2014/0260259 A1 9/2014 Ginesin et al.
2014/0260267 A1* 9/2014 Melton ..... F23R 3/283 60/737
2014/0260268 A1* 9/2014 Westmoreland ..... F23R 3/286 60/737
2014/0260271 A1 9/2014 Keener et al.
2014/0260276 A1 9/2014 Westmoreland et al.
2014/0260299 A1* 9/2014 Boardman ..... F23R 3/10 60/776
2014/0260300 A1 9/2014 Chila et al.
2014/0260315 A1* 9/2014 Westmoreland ..... F02C 7/20 60/796
2014/0283522 A1* 9/2014 Boardman ..... F23R 3/286 60/772
2014/0338338 A1* 11/2014 Chila ..... F23R 3/10 60/737
2014/0338339 A1 11/2014 Westmoreland et al.
2014/0338340 A1* 11/2014 Melton ..... F23D 14/62 60/738
2014/0338344 A1 11/2014 Stewart et al.
2014/0338354 A1 11/2014 Stewart et al.
2014/0338356 A1 11/2014 Keener et al.
2014/0367495 A1 12/2014 Monaghan et al.
2015/0000285 A1* 1/2015 Deiss ..... F02C 7/22 60/740
2015/0059353 A1 3/2015 Asai et al.
2015/0165568 A1 6/2015 Means et al.
2016/0040883 A1 2/2016 Asai et al.
2016/0060154 A1* 3/2016 Cowles ..... C03B 5/2356 65/134.5

OTHER PUBLICATIONS

U.S. Appl. No. 13/797,859, filed Mar. 12, 2013, Boardman et al.
U.S. Appl. No. 13/797,883, filed Mar. 12, 2013, Melton et al.
U.S. Appl. No. 13/797,896, filed Mar. 12, 2013, Westmoreland et al.
U.S. Appl. No. 13/797,912, filed Mar. 12, 2013, Chila et al.
U.S. Appl. No. 13/797,925, filed Mar. 12, 2013, Westmoreland et al.
U.S. Appl. No. 13/797,961, filed Mar. 12, 2013, Westmoreland et al.
U.S. Appl. No. 13/797,986, filed Mar. 12, 2013, Chila et al.
U.S. Appl. No. 13/798,012, filed Mar. 12, 2013, Melton et al.
U.S. Appl. No. 13/400,248, filed Feb. 20, 2012, Westmoreland et al.
U.S. Appl. No. 13/705,443, filed Dec. 5, 2012, Belsom et al.

* cited by examiner

SYSTEM AND METHOD HAVING MULTI-TUBE FUEL NOZZLE WITH MULTIPLE FUEL INJECTORS

BACKGROUND

The subject matter disclosed herein relates generally to gas turbine engines and, more particularly, fuel injectors in gas turbine combustors.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, e.g., an electrical generator. The gas turbine engine includes a fuel nozzle assembly, e.g., with multiple fuel nozzles, to inject fuel and air into a combustor. The design and construction of the fuel nozzle assembly can significantly affect the mixing and combustion of fuel and air, which in turn can impact exhaust emissions (e.g., nitrogen oxides, carbon monoxide, etc.) and power output of the gas turbine engine. Furthermore, the design and construction of the fuel nozzle assembly can significantly affect the time, cost, and complexity of installation, removal, maintenance, and general servicing. Therefore, it would be desirable to improve the design and construction of the fuel nozzle assembly.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-tube fuel nozzle. The multi-tube fuel nozzle includes multiple fuel injectors. Each fuel injector is configured to extend into a respective premixing tube of a plurality of mixing tubes. Each fuel injector includes a body, a fuel passage, and multiple fuel ports. The fuel passage is disposed within the body and extends in a longitudinal direction within a portion of the body. The multiple fuel ports are disposed along the portion of the body and coupled to the fuel passage. A space is disposed between the portion of the body with the fuel ports and the respective premixing tube.

In a second embodiment, a system includes a combustor end cover assembly, and a multi-tube fuel nozzle. The multi-tube fuel nozzle includes multiple fuel injectors coupled to the combustor end cover assembly. Each fuel injector is configured to extend into a respective premixing tube of a plurality of mixing tubes. Each fuel injector includes an annular portion, a tapered portion, a fuel passage, and multiple fuel ports coupled to the fuel passage. The tapered portion is downstream of the annular portion. The fuel passage extends through the annular portion. The multiple fuel ports are disposed in the annular portion, the tapered portion, or a combination thereof.

In a third embodiment, a method includes removing end cover assembly and a multi-tube fuel nozzle from a combuster, removing the end cover assembly from the multi-tube fuel nozzle, and removing at least one fuel injector from the end cover assembly. The multi-tube fuel nozzle includes multiple premixing tubes and multiple fuel injectors, wherein each fuel injector of the multiple fuel injectors is disposed within a respective premixing tube, and each fuel injector is coupled to the end cover assembly.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
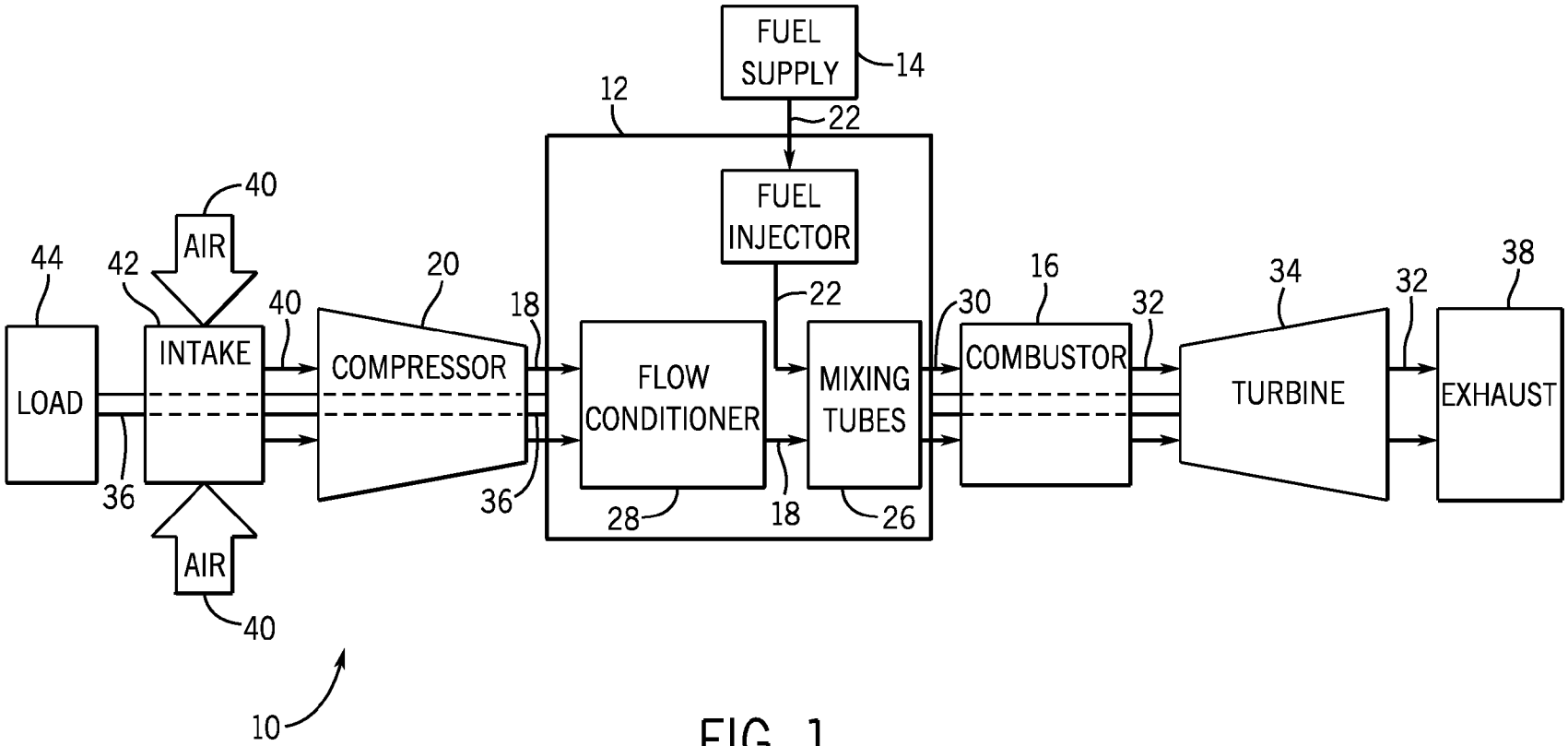
FIG. 1 is a block diagram of an embodiment of a gas turbine system having a micromixing fuel nozzle within a combustor, wherein the fuel nozzle employs multiple micromixing fuel injectors.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems for micromixing of air and fuel within fuel nozzles (e.g., multi-tube fuel nozzles) of gas turbine engines. As discussed in detail below, the multi-tube fuel nozzle includes a plurality of mixing tubes (e.g., 10 to 1000) spaced apart from one another in a generally parallel arrangement or tube bundle, wherein each mixing tube has a fuel inlet, an air inlet, and a fuel-air outlet. The mixing tubes also may be described as air-fuel mixing tubes, premixing tubes, or micromixing tubes, because each tube mixes fuel and air along its length on a relatively small scale. For example, each mixing tube may have a diameter of approximately 0.5 to 2, 0.75 to 1.75, or 1 to 1.5 centimeters. The fuel inlet may be disposed at an upstream axial opening, the fuel-air outlet may be disposed at a downstream axial opening, and the air inlet (e.g., 1 to 100 air inlets) may be disposed along a side wall of the mixing tube. Furthermore, each mixing tube may include a fuel injector coupled to and/or extending axially into the fuel inlet at the upstream axial opening of the mixing tube. The fuel injector, which may be described as a tube-level fuel injector of the multi-tube fuel nozzle, may be configured to direct fuel into the mixing tube in a variety of directions, such as one or more axial directions, radial directions, circumferential directions, or any combination thereof.

In certain embodiments, as discussed in detail below, each fuel injector includes a body, a fuel passage, and multiple fuel ports. The fuel passage is disposed within the body and extends in a longitudinal direction within a portion of the body. The multiple fuel ports are disposed along a portion of the body, and the fuel ports are coupled to the fuel passage. The portion of the body with the fuel ports is configured to be physically and thermally decoupled from the respective premixing tube. That is, because the components are not physically joined, heat transfer between the fuel injector and premixing tube is minimized. The body of the tube may include an annular portion that defines the fuel passage. The multiple fuel ports may be disposed on the annular portion. In some embodiments, the body may include an upstream end, a downstream end, and a tapered portion. The tapered portion tapers in a direction from the upstream end to the downstream end. The fuel passage extends into the tapered portion. Multiple fuel ports may be disposed on the tapered portion. In other embodiments, the body comprises an upstream end, a downstream end, an annular portion defining the fuel passage, and a tapered portion that tapers in a direction from the upstream end to the downstream end. The fuel passage of these embodiments may end prior to the tapered portion and the multiple fuel ports are disposed along the annular portion. Additionally, the annular portion may partially overlap the tapered portion to form an overlapped portion, and the multiple fuel ports may be disposed on the overlapped portion. The body may include an upstream portion having an outer surface configured to abut an inner surface of the respective premixing tube. In some embodiments, at least one fuel port of the multiple fuel ports is configured to radially inject fuel into the respective premixing tube. Furthermore, in some embodiments, at least one fuel port of the multiple fuel ports is configured to inject fuel in a direction having an axial, radial, and tangential component. The multiple fuel ports may include a first fuel port disposed at a first axial position along the portion of the body and a second fuel port disposed at a second axial position along the portion of the body.

As discussed below, each fuel nozzle is removable from its respective mixing tube, and may be coupled to a common mounting structure to enable simultaneous installation and removal of a plurality of fuel nozzles for the plurality of mixing tubes. For example, the common mounting structure may include a combustor end cover assembly, a plate, a manifold, or another structural member, which supports all or part of the plurality of fuel nozzles. Thus, during installation, the structure (e.g., end cover assembly) having the plurality of fuel nozzles may be moved axially toward the multi-tube fuel nozzle, such that all of the fuel nozzles are simultaneously inserted into the respective mixing tubes. Similarly, during removal, service, or maintenance operations, the structure (e.g., end cover assembly) having the plurality of fuel nozzles may be moved axially away from the multi-tube fuel nozzle, such that all of the fuel nozzles are simultaneously withdrawn from the respective mixing tubes. Embodiments of the fuel nozzles are discussed in further detail below with reference to the drawings.

Turning now to the drawings and referring first to FIG. 1, a block diagram of an embodiment of a gas turbine system 10 having a micromixing fuel nozzle 12 is illustrated. The gas turbine system 10 includes one or more fuel nozzles 12 (e.g., multi-tube fuel nozzles), a fuel supply 14, and a combustor 16. The fuel nozzle 12 receives compressed air 18 from an air compressor 20 and fuel 22 from the fuel supply 14. Although the present embodiments are discussed in context of air as an oxidant, the present embodiments may use air, oxygen, oxygen-enriched air, oxygen-reduced air, oxygen mixtures, or any combination thereof. As discussed in further detail below, the fuel nozzle 12 includes a plurality (e.g., 10 to 1000) of fuel injectors 24 and associated mixing tubes 26 (e.g., 10 to 1000), wherein each mixing tube 26 has an air flow conditioner 28 to direct and condition an air flow into the respective tube 26, and each mixing tube 26 has a respective fuel injector 24 (e.g., disposed within the tube 26 in a coaxial or concentric arrangement) with fuel ports 25 to inject fuel into the respective tube 26. Each mixing tube 26 mixes the air and fuel along its length, and then outputs an air-fuel mixture 30 into the combustor 16. In certain embodiments, the mixing tubes 26 may be described as micromixing tubes, which may have diameters between approximately 0.5 to 2, 0.75 to 1.75, or 1 to 1.5 centimeters, and all subranges therebetween. The fuel injectors 24 and corresponding mixing tubes 26 may be arranged in one or more bundles (e.g., 1, 2, 3, 4, 5, 6, 7, 8, 9, 10, or more) of closely spaced fuel injectors 24, generally in a parallel arrangement relative to one another. In this configuration, each mixing tube 26 is configured to receive fuel from a fuel injector 24 and to mix (e.g., micromix) fuel and air on a relatively small scale within each mixing tube 26, which then outputs the fuel-air mixture 30 into the combustion chamber. Features of the disclosed embodiments of the fuel injector 24 enable efficient fuel dispersement into the mixing tube 26. Additionally, the disclosed embodiments of fuel injectors 24 are thermally and physically decoupled from the premixing tubes 26, such that the fuel injectors 24 may be easily removed for simplified inspection, replacement or repair.

The combustor 16 ignites the fuel-air mixture 30, thereby generating pressurized exhaust gases 32 that flow into a turbine 34. The pressurized exhaust gases 32 flow against and between blades in the turbine 34, thereby driving the turbine 34 to rotate a shaft 36. Eventually, the exhaust 32 exits the turbine system 10 via an exhaust outlet 38. Blades within the compressor 20 are additionally coupled to the shaft 36, and rotate as the shaft 36 is driven to rotate by the turbine 34. The rotation of the blades within the compressor 20 compresses air 18 that has been drawn into the compressor 20 by an air intake 42. The resulting compressed air 18 is then fed into one or more multi-tube fuel nozzles 12 in each of the combustors 16, as discussed above, where it is mixed with fuel 22 and ignited, creating a substantially self-sustaining process. Further, the shaft 36 may be coupled to load 44. As will be appreciated, the load 44 may be any suitable device that may generate power via the torque of the turbine system 10, such as a power generation plant or an external mechanical load. The implementation of the fuel injectors 24 will be discussed in greater detail below.

Figure 2:
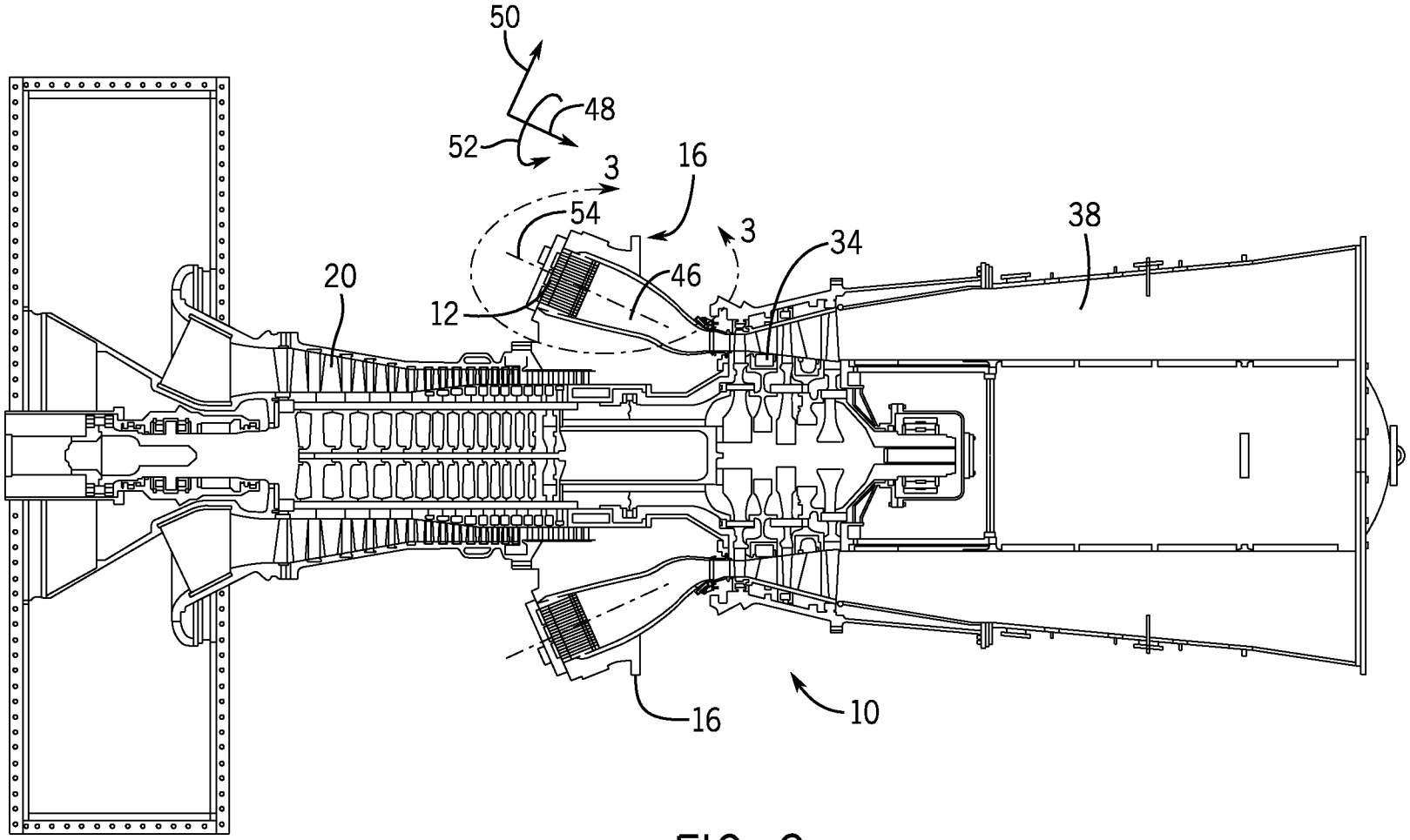
FIG. 2 is a cross-sectional side view of the embodiment of a gas turbine system of FIG. 1 illustrating the physical relationship among components of the system.

FIG. 2 shows is a cross-sectional side view of the embodiment of a gas turbine system 10 of FIG. 1 illustrating the physical relationship among components of the system 10. As depicted, the embodiment includes the compressor 20, which is coupled to an annular array of combustors 16. Each combustor 16 includes at least one fuel nozzle 12 (e.g., a multi-tube fuel nozzle). Each fuel nozzle 12 includes multiple fuel injectors 24, which disperse fuel into multiple mixing tubes 26 where the fuel is mixed with pressurized air 18. The fuel injectors 24 help to improve the fuel air mixing in the mixing tubes 26 by injecting the fuel in various directions, such as one of more axial directions, radial directions, circumferential directions, or a combination thereof. The mixing tubes 26 feed the fuel-air mixture 30 to a combustion chamber 46 located within each combustor 16. Combustion of the fuel-air mixture 30 within combustors 16, as mentioned above, causes blades within the turbine 34 to rotate as exhaust gases 32 (e.g., combustion gases) pass toward an exhaust outlet 38. Throughout the discussion, a set of axes will be referenced. These axes are based on a cylindrical coordinate system and point in an axial direction 48, a radial direction 50, and a circumferential direction 52. For example, the axial direction 48 extends along a length or longitudinal axis 54 of the fuel nozzle 12, the radial direction 50 extends away from the longitudinal axis 54, and the circumferential direction 52 extends around the longitudinal axis 54. Additionally, a tangential 55 direction may be referred to.

Figure 3:
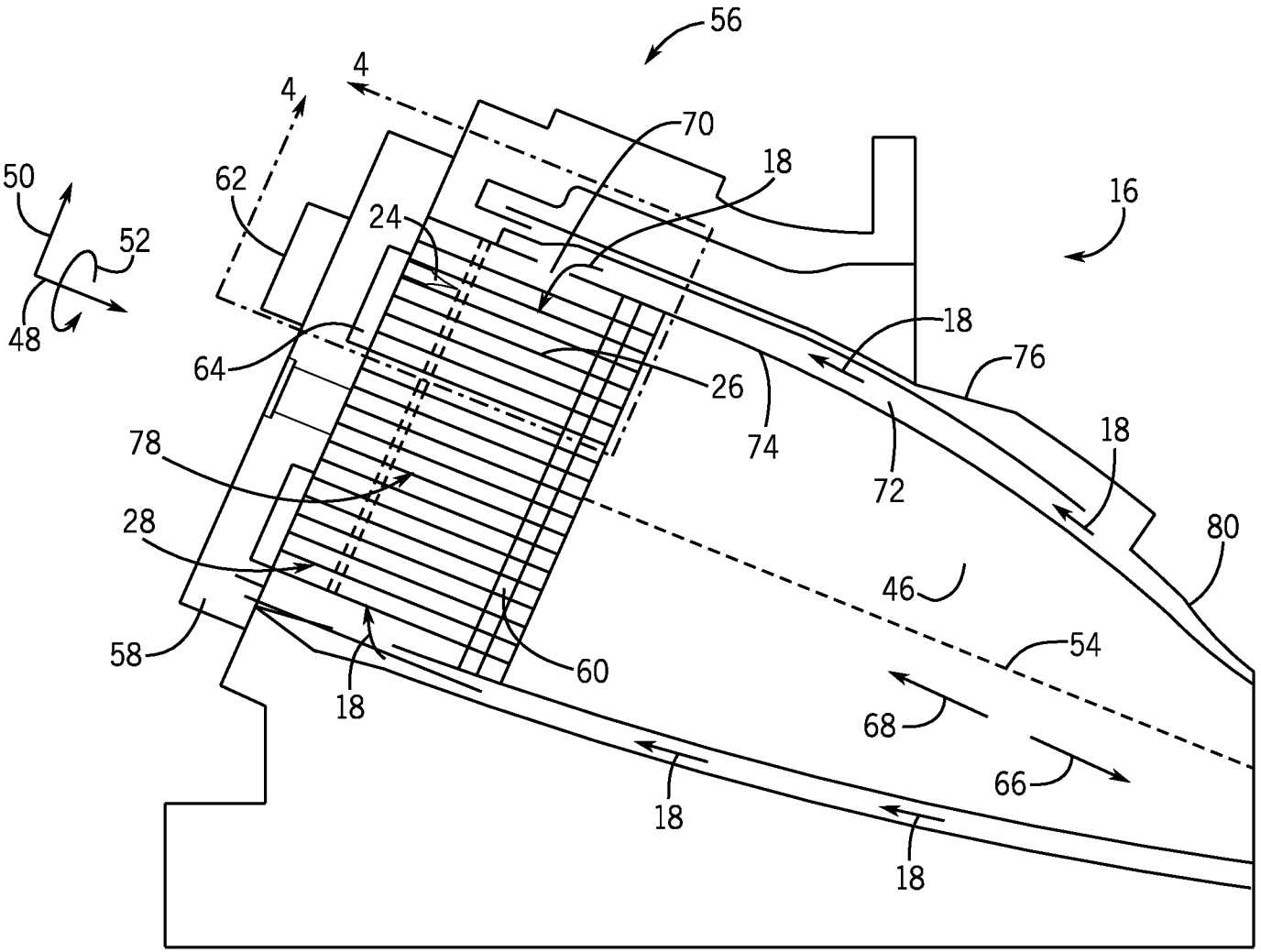
FIG. 3 is a cross-sectional side view of an embodiment of a portion of the combustor of FIG. 2, taken within line 3-3, illustrating a micromixing fuel nozzle coupled to an end cover assembly of the combustor.

FIG. 3 is a cross-sectional side view of an embodiment of a portion of the combustor 16 of FIG. 2, taken within line 3-3. As shown, the combustor 16 includes a head end 56 and the combustion chamber 46. The fuel nozzle 12 is positioned within the head end 56 of the combustor 16. Within the fuel nozzle 12 are suspended the multiple mixing tubes 26 (e.g., air-fuel premixing tubes). The mixing tubes 26 generally extend axially 48 between an end cover assembly 58 of the combustor 16 and a cap face assembly 60 of the fuel nozzle 12. The mixing tubes 26 may be configured to mount within the fuel nozzle 12 between the end cover assembly 58 and cap face assembly 60 in a floating configuration. For example, in some embodiments, each mixing tube 26 may be supported in a floating configuration by one or more axial springs and/or radial springs to absorb axial and radial motion that may be caused by thermal expansion of the tubes 24 during operation of the fuel nozzle 12. The end cover assembly 58 may include a fuel inlet 62 and fuel plenum 64 for providing fuel 22 to multiple fuel injectors 24. As discussed above, each individual fuel injector 24 is disposed within an individual mixing tube 26 in a removable manner. In certain embodiments, the fuel injector 24 and mixing tube 26 are separate components, which are physically separate and thermally decoupled to help resist heat transfer into the fuel injector 24. During the combustion process, fuel 22 moves axially through each of the mixing tubes 26 from the end cover assembly 58 (via the fuel injectors 24) through the cap face assembly 60 and to the combustion chamber 46. The direction of this movement along the longitudinal axis 54 of the fuel nozzle 12 will be referred to as the downstream direction 66. The opposite direction will be referred to as the upstream direction 68.

As described above, the compressor 20 compresses air 40 received from the air intake 42. The resulting flow of pressurized compressed air 18 is provided to the fuel nozzles 12 located in the head end 56 of the combustor 16. The air enters the fuel nozzles 12 through air inlets 70 (e.g., radial air inlets) to be used in the combustion process. More specifically, the pressurized air 18 flows from the compressor 20 in an upstream direction 68 through an annulus 72 formed between a liner 74 (e.g., an annular liner) and a flow sleeve 76 (e.g., an annular flow sleeve) of the combustor 16. Where the annulus 72 terminates, the compressed air 18 is forced into the air inlets 70 of the fuel nozzle 12 and fills an air plenum 78 within the fuel nozzle 12. The pressurized air 18 in the air plenum 78 then enters the multiple mixing tubes 26 through the air flow conditioner 28 (e.g., multiple air ports or an air inlet region). Inside the mixing tubes 26, the air 18 is then mixed with the fuel 22 provided by the fuel injectors 24. The fuel-air mixture 30 flows in a downstream direction 66 from the mixing tubes 26 into the combustion chamber 46, where it is ignited and combusted to form the combustion gases 32 (e.g., exhaust gases). The combustion gases 32 flow from the combustion chamber 46 in the downstream direction 66 to a transition piece 80. The combustion gases 22 then pass from the transition piece 80 to the turbine 34, where the combustion gases 22 drive the rotation of the blades within the turbine 34.

Figure 4:
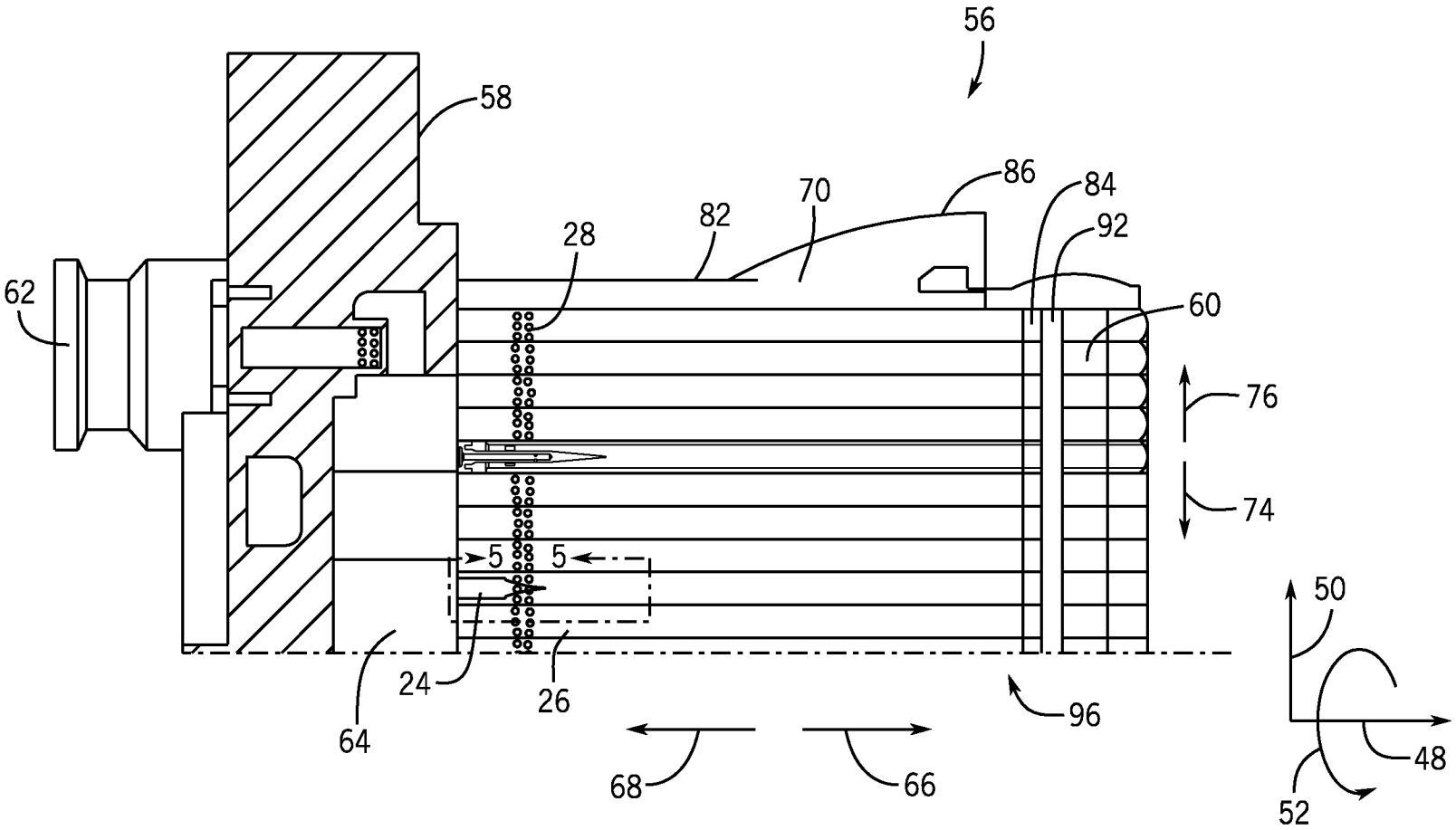
FIG. 4 is a partial cross-sectional side view of the combustor of FIG. 3, taken within line 4-4 of FIG. 3, showing details of the micromixing fuel nozzle.

FIG. 4 is a partial cross-sectional side view of the combustor 16 as taken within line 4-4 of FIG. 3. The head end 56 of the combustor 16 contains a portion of the multi-tube fuel nozzle 12. A support structure 82 surrounds the multi-tube fuel nozzle 12 and the multiple mixing tubes 26 and defines an air plenum 78. As discussed above, in some embodiments, each mixing tube 26 may extend axially between the end cover assembly 58 and the cap face assembly 60. The mixing tubes 26 may further extend through the cap face assembly 60 to provide the fuel-air mixture 30 directly to the combustion chamber 46. Each mixing tube 26 is positioned to surround a fuel injector 24 (e.g., coaxial or concentric arrangement), such that the injector 24 receives fuel 22 from the fuel plenum 64 and directs the fuel into the tube 26. Each mixing tube 26 includes an air flow conditioner 28 which conditions air as it enters the tube 26. Features of the fuel injector 24 to be disclosed below, enable the injector 24 to efficiently disperse fuel into the pressurized air 18 in the tubes 26. The fuel plenum 64 is fed fuel 22 entering the fuel inlet 62 located on the end cover assembly 58. In some embodiments, a retainer plate 84 and/or an impingement plate 92 may be positioned within the fuel nozzle 12 surrounding the downstream end 96 of the mixing tubes 26 generally proximate to the cap face assembly 60. The impingement plate 92 may include a plurality of impingement cooling orifices, which may direct jets of air to impinge against a rear surface of the cap face assembly 60 to provide impingement cooling.

Figure 5:
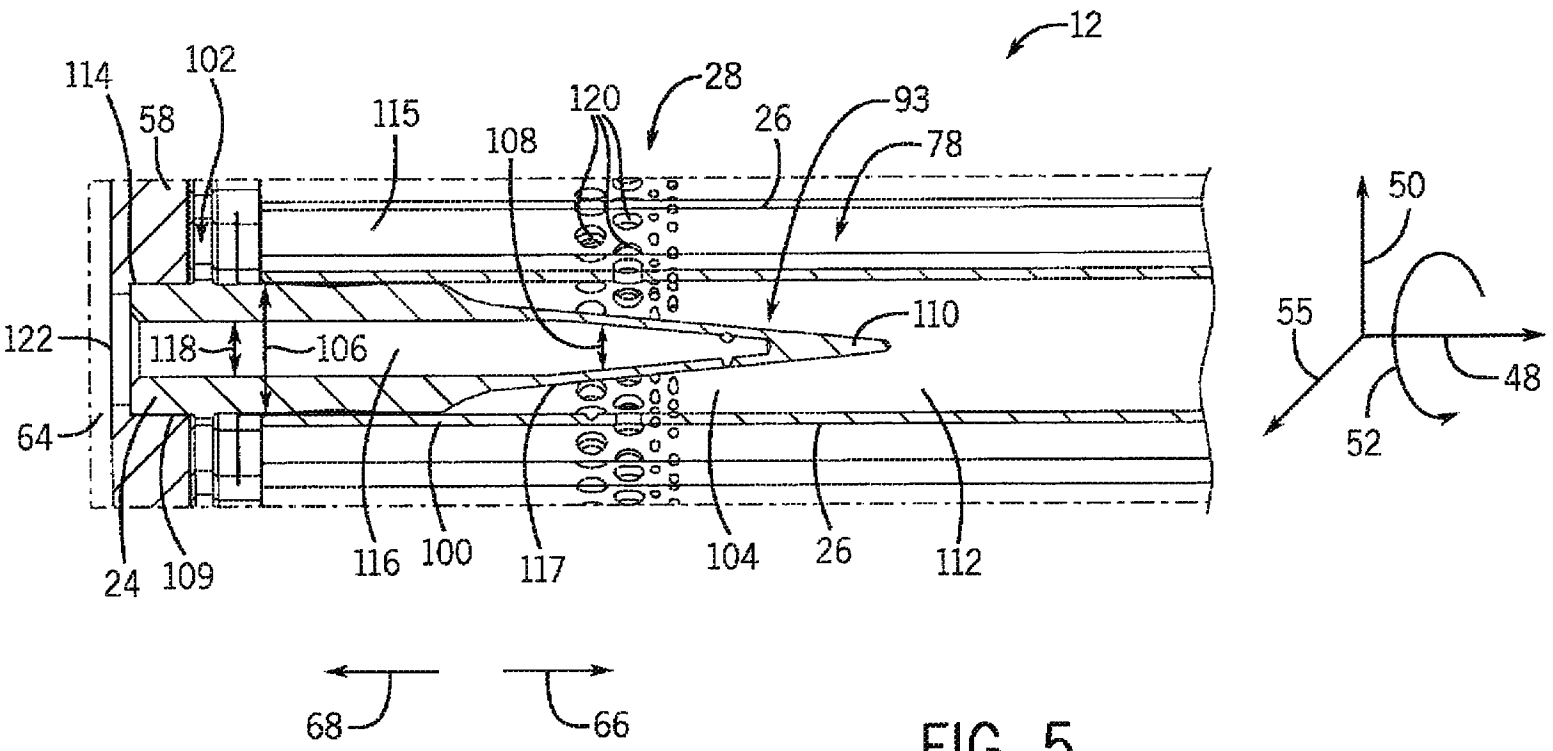
FIG. 5 is a cross-sectional side view of an embodiment of the micromixing fuel injector and mixing tube of the micromixing fuel nozzle of FIG. 4, taken within line 5-5, showing details of an embodiment of the micromixing fuel injector spike configured to be disposed within a mixing tube with air ports, including an upstream portion with a constant diameter, a downstream portion that is tapered, and a fuel passage that extends into the downstream tapered portion.

FIG. 5 is a cross-sectional side view of an embodiment of the micromixing fuel injector 24 (e.g., fuel injector spike 93) and mixing tube 26 of the micromixing fuel nozzle 12 of FIG. 4, taken within line 5-5. Illustrated are details of the micromixing fuel injector 24 axially extending into the mixing tube 26 of the micromixing fuel nozzle 12. The fuel injector 24 includes a main body 100 with an upstream portion 102 and a downstream portion 104. In certain embodiments, a diameter 106 of an outer surface 109 of the upstream portion 102 remains constant in the axial 48 direction. The diameter 108 of the outer surface 109 of the downstream portion 104 of the fuel injector 24 decreases in the downstream 66 axial direction so that the fuel injector 24 gradually tapers to a point 110 to define the spike 93 (e.g., a converging annular portion or conical portion). The upstream portion 102 of the fuel injector 24 is directly adjacent to an inner surface 112 of the mixing tube 26. The downstream portion 104 decreases in diameter, within the mixing tube 26 to define a space (e.g., mixing region) between the fuel injector 24 and mixing tube 26, wherein the fuel 22 and air 18 meets and mixing the tube 26. The proximity of the mixing tube 26 to the combustion chamber 46 results in heat transfer into the tube 26. The fuel injector 24 and mixing tube 26 are physically and thermally decoupled, such that the heat transfer into the fuel injector 24 may be minimized. As shown, an upstream end 114 of the fuel injector 24 is coupled to the end cover assembly 58. The fuel injector 24 may be coupled to the end cover assembly 58 by various couplings, such as a brazed joint, a welded joint, a bolt, or threaded connection, a wedge-fit, an interference fit, or any combination thereof. As discussed further below, the disclosed embodiments allow the fuel injectors 24 to be accessible to be inspected and/or removed from the end cover assembly 58 and easily reinstalled. The fuel injector 24 includes an annular portion 115 that defines a fuel passage 116. The annular portion 115 extends throughout the upstream portion 102 and overlaps into the tapered downstream portion 104 of the spike 24 in an overlapped portion 117. When the fuel injector 24 is installed on the end cover assembly 58, as shown, the fuel passage 116 is coupled to the fuel plenum 64 of the fuel nozzle 12 located within the end cap assembly 58. This coupling allows the fuel injector 24 to receive fuel 22 from the fuel plenum 64 of the end cover assembly 58. In certain embodiments, the fuel passage 116 receiving the fuel has a diameter 118 that is constant within the upstream portion 102 of the fuel injector 24 and gradually decreases on the tapered downstream portion 104 of the fuel injector 24.

Disposed on the downstream portion 104 of the fuel injector 24 are multiple fuel ports 25 extending through the annular portion 115 of the fuel injector 24 enabling fuel to flow in an outward direction (e.g., a direction with radial, circumferential, an/or axial components) from the fuel injector 24 into the mixing tube 26. There may be 1, 2, 3, 4, 5, 6, 7, 8, 9, 10, or any other number of fuel ports 25 on the fuel injector 24. The fuel ports 25 may be located around the circumference of the fuel injector 24 at the same axial 48 location along the body 100 of the fuel injector, or may have varying axial 48 locations along the body 100. For example, a fuel injector 24 may one or more fuel ports 25 disposed at 1, 2, 3, 4, 5, 6, 7, 8, 9, 10, or more axial locations, which are axially offset from each other. Upstream 68 from the fuel ports 25 on the spike 24 and located on the mixing tube 26 is the air flow conditioner 28. In the present embodiment, the air flow conditioner 28 includes multiple air ports 120 that direct compressed air 18 from the fuel nozzle fuel plenum 64 into the mixing tube 26. As discussed above, the air ports 120 enable air from the fuel nozzle air plenum 78 to enter the mixing tubes 26. The tapered shape of the downstream portion 104 of the fuel injector 24 may be an aerodynamic shape that eliminates or minimizes bluff-body wakes within the premixing tube 26. The possibility of flame holding may also be minimized by the aerodynamic shape of the fuel injector 24. The gradual tapering of the injector spike 93 enables the fuel-air mixture 30 to gradually diffuse and create a substantially uniform fuel-air mixture 30. In the present embodiment, the fuel ports 25 direct fuel in a substantially radial 50 direction (e.g. a direction with a compound angle with respect to a longitudinal axis 122 of the fuel injector 24). In other embodiments, as discussed below, the fuel ports 25 may be configured to direct fuel in various directions (e.g., directions with axial 48 and/or tangential 55 components). The tangential direction 55 of fuel ports 25 is configured to direct the fuel circumferentially 52 about the axis 122 to generate a swirling flow. Additionally, in other embodiments, the fuel ports 25 may be positioned in a more upstream position relative to the location of the air ports 120.

Figure 6:
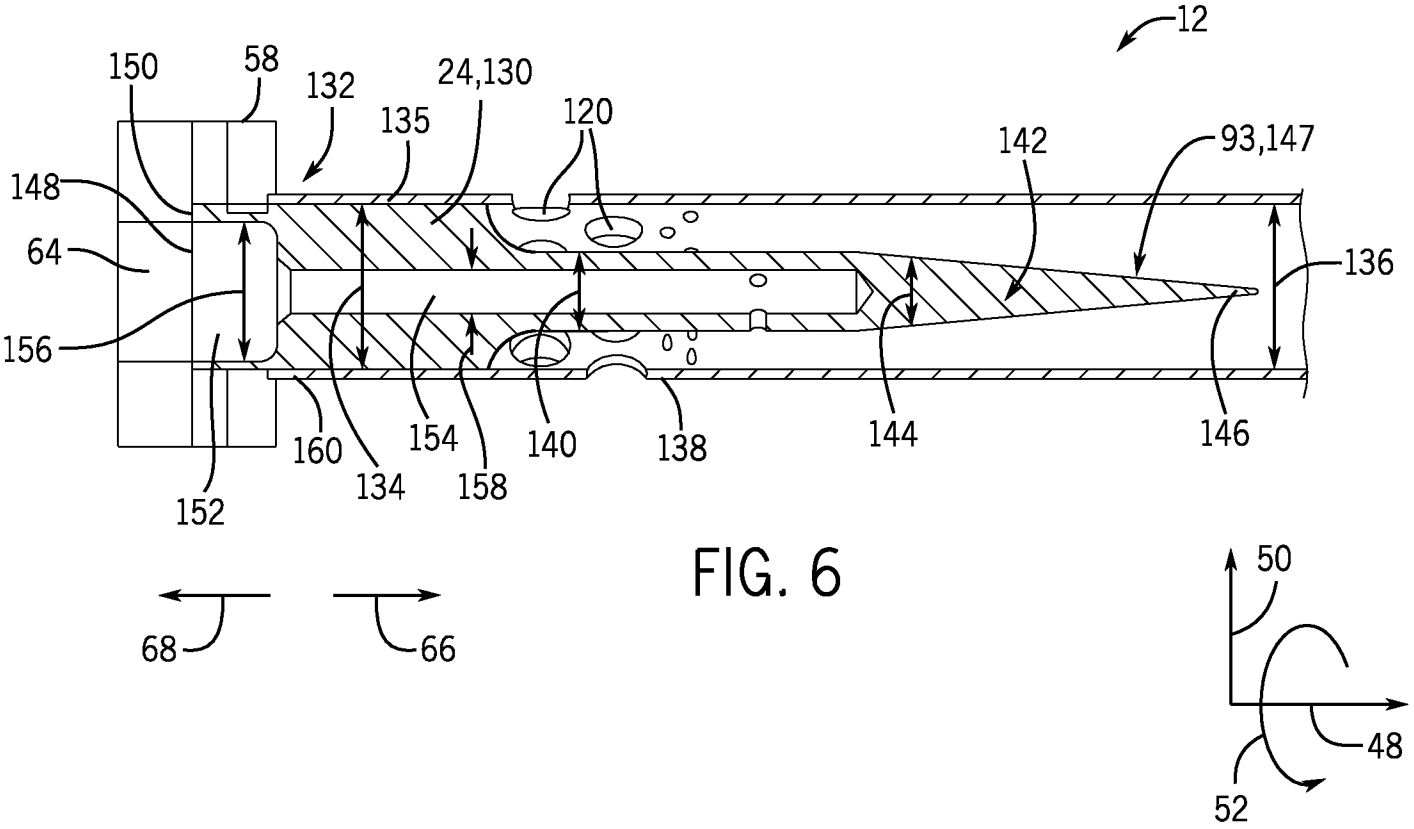
FIG. 6 is a cross-sectional side view of an embodiment of the micromixing fuel injector and mixing tube of the micromixing fuel nozzle of FIG. 4, taken within line 5-5, showing details of an embodiment of the micromixing fuel injector spike configured to be disposed within a mixing tube with air ports, including an upstream portion with a constant diameter, a central portion of a smaller diameter, a downstream portion that is tapered, and a fuel passage that terminates upstream of the tapered downstream portion.

FIG. 6 is a cross-sectional side view of an additional embodiment of the micromixing fuel injector 24, 130 and mixing tube 26 of the micromixing fuel nozzle 12 of FIG. 4, taken within line 5-5, showing details of the micromixing fuel injector 130. Similar to the previous embodiment, the fuel injector 130 includes an upstream portion 132 that has a diameter 134 between an outer surface 135 approximately equal to or slightly less than that of the interior diameter 136 of the mixing tube 26. The fuel injector 130 additionally includes a central axial portion 138 having a diameter 140 between the outer surface 135 that is significantly smaller than the diameter 134 between the outer surface 135 of the upstream portion 132. Downstream 66 of the central portion 138, a downstream portion 142 of the fuel injector 130 has a diameter 144 between the outer surface 135 that gradually decreases, so that the fuel injector 130 gradually tapers to a point 146 to define the spike 93, 147. The tapered shape of the downstream portion 142 of the fuel injector 130 is an aerodynamic shape that eliminates or minimizes bluff-body wakes and flame holding within the premixing tube 26.

A fuel passage 148 extends from an upstream end 150 of the fuel injector 130 and through the central portion 138 of the fuel injector 130. An upstream portion 152 of the fuel passage 148 that is disposed within the end cover assembly 58 receives fuel from the fuel plenum 64 and has a diameter 156 greater than a diameter 158 of a downstream portion 154 of the fuel passage 148. Along the central portion 138 of the fuel injector 130, the diameter 158 of the fuel passage 148 is smaller relative to the diameter 152 of the upstream portion 152 and is constant along the axial 48 direction. A central portion 160 of the fuel passage 148 is stepped and tapered (e.g., conical) to create a graduated transition between the upstream portion 152 and downstream portion 154 of the fuel passage 148. This configuration of the fuel passage 148 may enable fuel 22 to make a substantially smooth transition from the fuel plenum 64, through the upstream portion 152 of the fuel passage 148, and into the downstream portion 154 of the fuel passage 148. This gradual narrowing (e.g., conical) of the fuel passage 148 may minimize disturbances such as wakes and turbulence as the fuel 22 is moved from the fuel supply 14 into the fuel injector 130. In the present embodiment, the fuel passage 148 terminates upstream 68 of the tapered downstream portion 142 of the fuel injector 130. Accordingly, fuel ports 25 extend through the body of the fuel injector 130 and are couple to the fuel passage 148. The fuel ports 25 are disposed at an axial 48 location downstream 66 of the air ports 120 of the mixing tube 26 and on the central portion 138 of the fuel injector 130. Thus, the air 18 and fuel 22 enter at locations that are axially the same as the central portion 138 of the fuel injector spike 130, where the diameter 140 is constant. The fuel injector 130 tapers downstream 66 of the central portion 138 of the fuel injector 130, air ports 120 of the mixing tube 26, and fuel ports 25 of the fuel injector 130, thereby enabling gradual diffusion and mixing of the fuel 22 and air 18 as it moves downstream 66.

Figure 7:
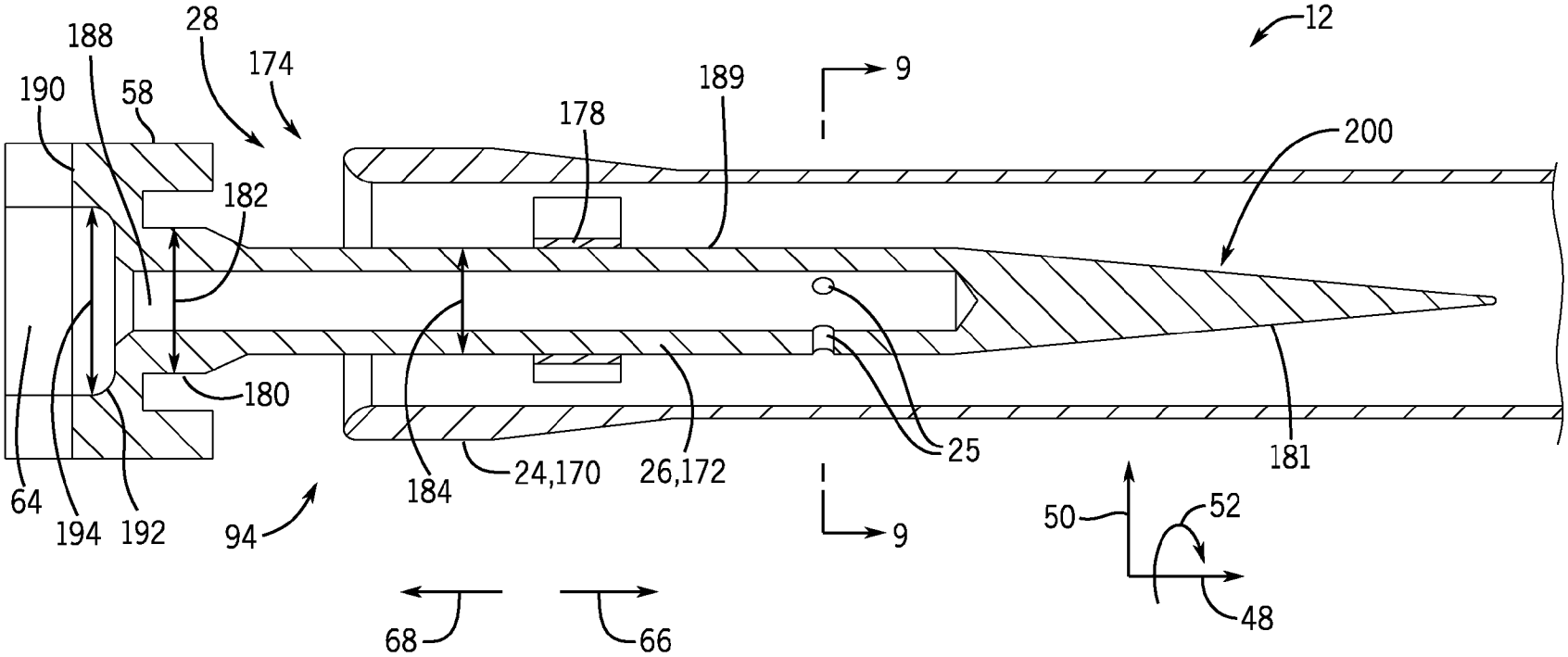
FIG. 7 is a cross-sectional side view of an embodiment of the micromixing fuel injector and mixing tube of the micromixing fuel nozzle of FIG. 4, taken within line 5-5, showing details of an embodiment of the micromixing fuel injector spike configured to be disposed with a mixing tube with an air inlet region including an abbreviated upstream portion with a constant diameter, a central portion of a smaller diameter, a downstream portion that is tapered, and a fuel passage that terminates upstream of the tapered downstream portion.

FIG. 7 is a cross-sectional side view of an embodiment of a micromixing fuel injector 24, 170 and mixing tube 26, 172 of the micromixing fuel nozzle 12 of FIG. 4, taken within line 5-5, showing details of the micromixing fuel injector 170 configured to be disposed within a mixing tube 26, 172 with an air inlet region 174. Shown is an embodiment of the mixing tube 172 with an air flow conditioner 28 that includes an air inlet region 174 upstream 68 of the mixing tube 172. In this embodiment of the fuel nozzle 12, the body of the fuel injector 170 is partially axially offset out of the mixing tube 172. This physical separation (e.g., axial offset) enables air to enter the mixing tube 172 through the air inlet region 174 (e.g., a bellmouth-shaped air inlet region of the mixing tube 172), where the air mixes with fuel 22 on the interior of the mixing tube 172. The mixing tube 172 is supported by strut supports 178 (e.g., radial arms) that extend radially inward and surround the fuel injector 170 while still enabling air 18 to pass axially 48. The strut supports 178 may have an aerodynamic airfoil shape. There may be 1, 2, 3, 4, 5, 6, 7, 8, 9, 10 or more strut supports 178. In order to maximize the clearance provided near the air inlet region 174 the present embodiment of the fuel injector 170 has an abbreviated upstream portion 180 with a diameter 182 between an outer surface 181 that is only slightly greater than the diameter 184 between the outer surface 181 of a central portion 186 of the fuel injector 170. The central portion 186 extends from the end cover assembly 58 axially into the mixing tube 172. A fuel passage 188 extends from an upstream end 190 of the fuel injector 170 through the central portion 186 of the fuel injector 170. An upstream portion 192 of the fuel passage 188 that is disposed within the end cover assembly 58 has a larger diameter 194 than a downstream portion 196 of the fuel passage 188 that is within the central portion 186 of the fuel injector 170. The fuel passage 188 also has a central portion 198 that is curved and tapered (e.g., conical) to gradually direct the fuel 22 into the narrower downstream portion 196 of the fuel passage 188. As discussed above, this configuration of the fuel passage 188 enables a smooth transition of fuel from the fuel plenum 64 into the fuel injector 170. The fuel ports 25 extend through an annular portion 189 of the fuel injector and are coupled to the fuel passage 188. As pictured, the fuel ports 25 are disposed on the central portion 186 of the fuel injector 170 upstream of a tapered downstream portion 200 (e.g., a converging annular portion, conical portion, or spike) of the fuel injector 170. The location of fuel ports 25 upstream of the tapered portion 200 of the fuel injector 170 enables the air 18 and fuel 22 to meet in an area of constant diameter 184 where the fuel injector 170 includes a constant diameter of the outer surface 181. Thus, gradual mixing of the fuel and air is enabled over the tapered downstream portion 200 of the fuel injector spike 170 as the mixture moves downstream 66.

Figure 8:
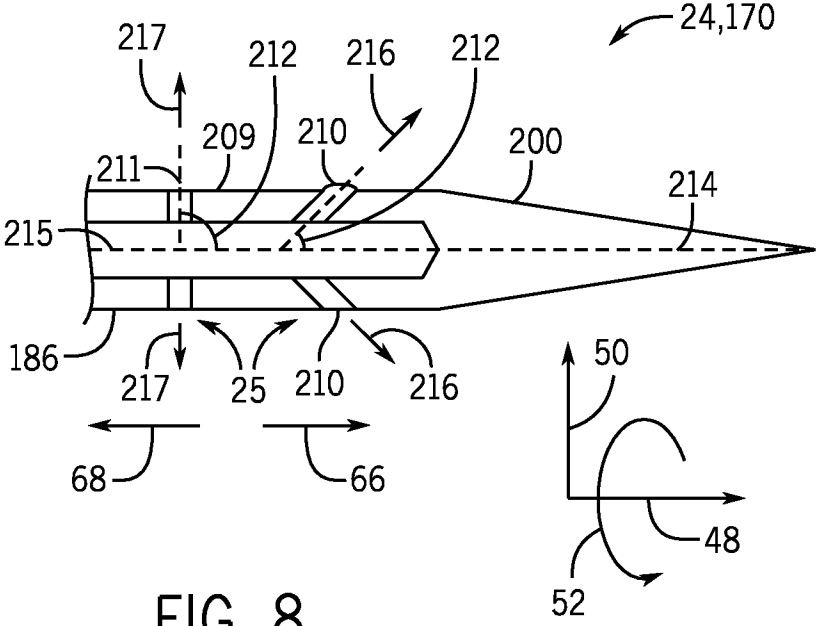
FIG. 8 is cross-sectional view of an embodiment of a micromixing fuel injector spike, of FIG. 5, showing details of the fuel ports including various axial positions and configurations to direct fuel in directions with an axial component.

FIG. 8 is cross-sectional view of the fuel injector 24, 170 of FIG. 7, illustrating the central portion 186 of constant diameter 184 and the downstream tapered portion 200. Illustrated are details of an embodiment of the fuel ports 210, 211. As discussed above, air pressures and velocities of air distributed among tubes 26, 172 can vary by location within the fuel nozzle 12 (e.g., lower air pressure as distance from air inlets 70 increases). In order improve uniformity of mixing among tubes 26, 172 fuel ports 210, 211 on the fuel injectors 170 paired with their respective tubes 26 may be disposed at various axial 48 locations on annular portion 209 of the fuel injector 170. Additionally, fuel ports 210, 211 may be configured to deliver fuel in various angles 212 relative to a main longitudinal axis 214 of the tube 26, 172 and fuel injector 24, 170. The angle of the fuel ports 210, 211 may be 0 to 90, 10 to 80, 20 to 70, 30 to 60, 40 to 50, 10, 20, 30, 40, 50, 60, 70, 80, or 90 degrees in an upstream 68 or downstream direction 66. Disposed on the fuel injector 170 and coupled to a fuel passage 215 are fuel ports 210 at a first axial location, and another set of fuel ports 211 at a second upstream 68 axial location. As shown, the more downstream 66 fuel ports 210 are configured to distribute the fuel 22 into the mixing tube 26 in a direction with a downstream 66 axial component (e.g., an axially downstream direction indicated by arrow 216). The upstream fuel ports 211 are configured to direct fuel in a radial direction 217 with no axial component (e.g., perpendicular angle 212). By location of fuel ports 210, 211 and the direction that they are configured to direct fuel, fuel injection can be catered to the expected conditions within individual mixing tubes 24. In other embodiments, the fuel ports 25 may be configured to direct the fuel in a direction with a greater or lesser downstream 66 axial component. By configuring the direction of the fuel ports 210 downstream 66, the occurrence of fuel blockage at the fuel ports 210 by incoming high pressured air 18 may be avoided or minimized. Alternatively, the fuel ports 210 may be configured to direct fuel 22 in a direction with an upstream 68 axial component. These variations in the angular configuration of the fuel ports 210 may compensate for varying conditions of the environment within the fuel nozzle 12 that may affect the uniformity of the fuel-air mixture 30 (e.g., local variations in the pressure and axial velocity of air 18).

Figure 9:
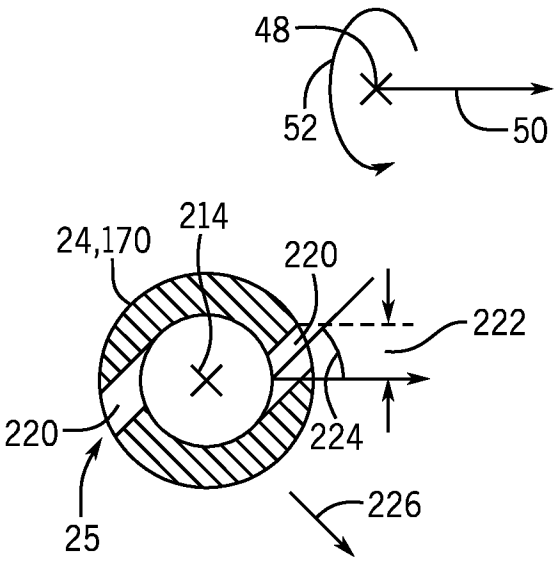
FIG. 9 is cross-sectional view of an embodiment of the micromixing fuel injector spike, taken along line 9-9 of FIG. 5, showing details of the fuel ports that direct fuel in a direction with a tangential component.

FIG. 9 is cross-sectional view of the micromixing fuel injector 170 of FIG. 7, taken along line 9-9, showing details of an additional embodiment of the fuel ports 25, 220. Illustrated are fuel ports 25, 220, according to some embodiments, that are configured to disperse fuel 22 into the mixing tube 26, 172 in a direction with a tangential component 222. That is, an angle 224 of the fuel port 220 in relation to a radial axis 50 is greater than zero. For example, the angle 224 of the fuel ports 220 may range between approximately 0 to 45 degrees, 0 to 30 degrees, 15 to 46 degrees, 15 to 30 degrees, 45 to 90 degrees, 60 to 90 degrees, 45 to 75 degrees, or 60 to 75 degrees, and all subranges therebetween. The angle 224 may be configured to direct the injected fuel circumferentially 52 about the axis 214 to provide a swirling fuel flow, which may improve the uniformity of the resulting fuel-air mixture 30. For example, the angle 224 of some fuel ports 220 may be approximately 5, 10, 15, 20, 25, 30, 35, 40, or 45 degrees, or any other angle, and the angle 224 of other fuel ports 220 may be 5, 10, 15, 20, 25, 30, 40 or 45 degrees, or any other angle. In some embodiments, fuel ports 220 may be configured to swirl the fuel about the axis 214 in a clockwise manner, while other fuel ports 220 may be configured to swirl the fuel about the axis 214 in a counter-clockwise manner. This variation in swirl direction may be made based on the circumferential location of the individual fuel injector 24, 170 and corresponding mixing tube 26, 172 in relation to the air inlet 70 of the fuel nozzle 12.

Figure 10:
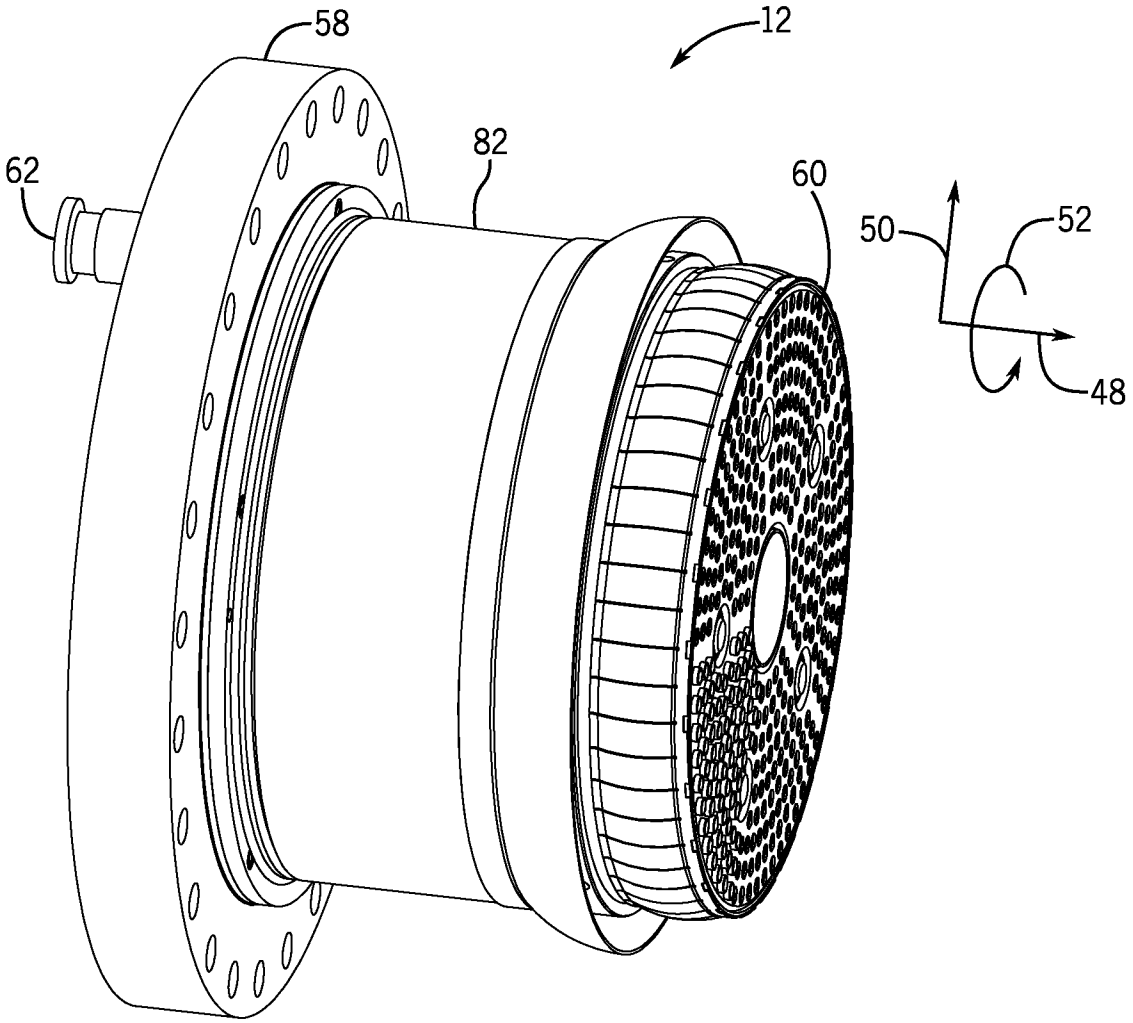
FIGS. 10-12 are a series of views of an embodiment of the micromixing fuel nozzle coupled to a combustor end cover assembly illustrating a method of removal of fuel injectors.
Figure 11:
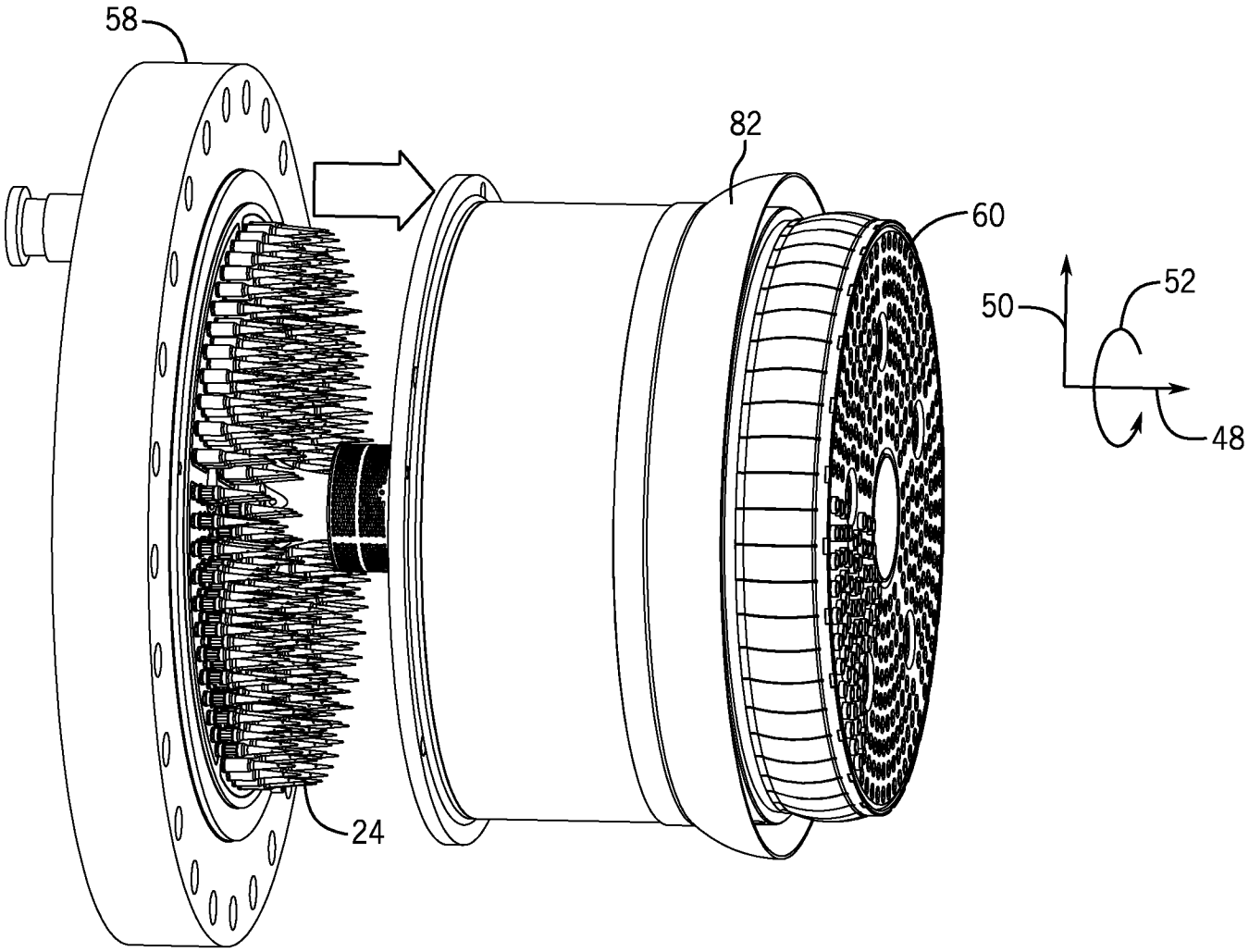
Figure 12:
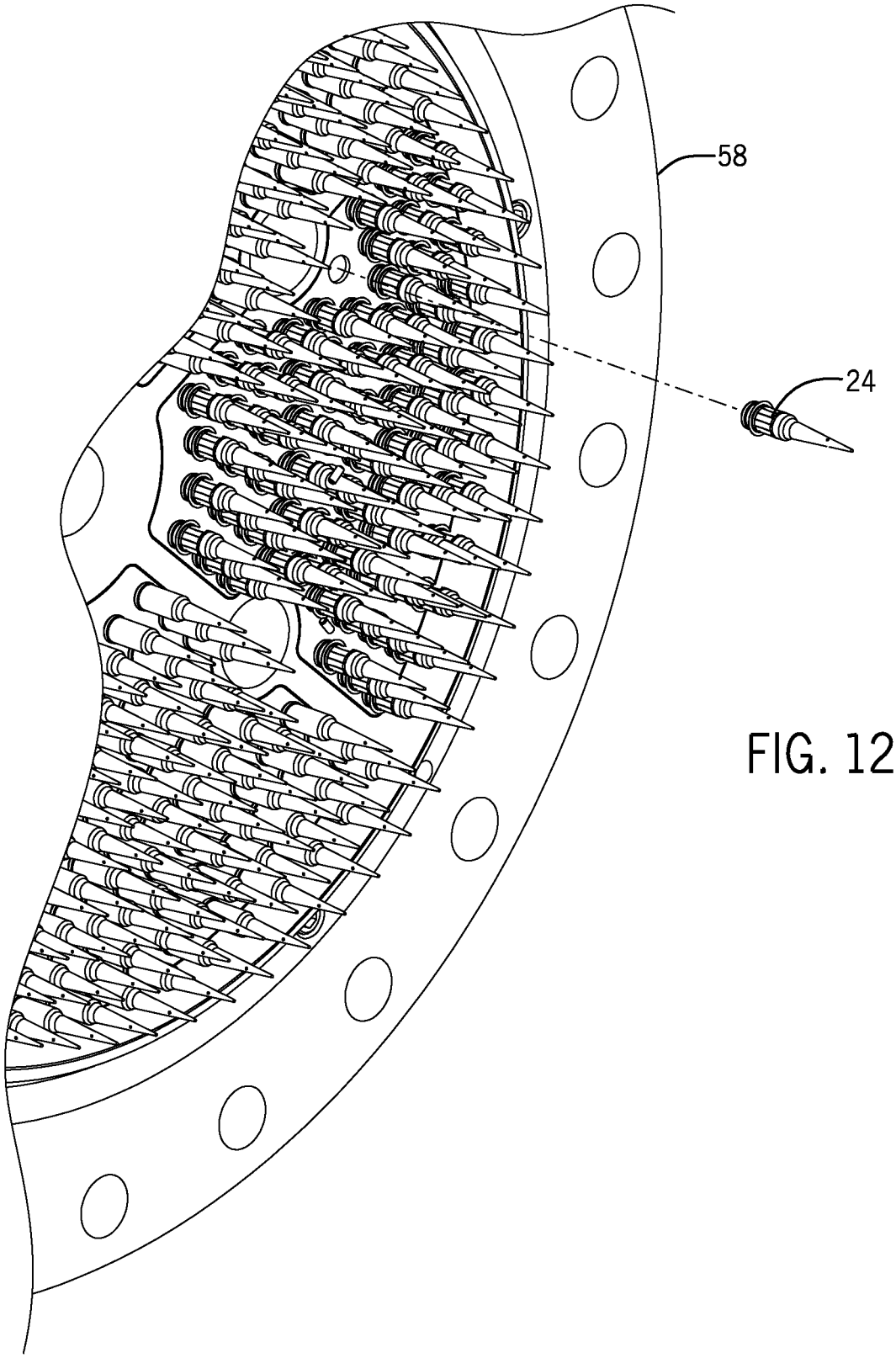

FIGS. 10-12 are a series of views of an embodiment of the micromixing fuel nozzle 12 coupled to a combustor end cover assembly 58 illustrating a method of removal of fuel injectors 24. FIG. 10 depicts the multi-tube fuel nozzle 12 removed from the head end 56 of the combustor 16 and coupled to the end cover assembly 58. Illustrated is the end cover assembly 58 with fuel inlet 62 coupled with the support structure 82 and cap face assembly 60. To access the fuel injectors 24, as illustrated in FIG. 11, the end cover assembly 58 is separated from the support structure 82 and cap face assembly 60. Removal of the support structure 82 and cap face assembly 60 reveals the fuel injectors 24 coupled to the end cover assembly 58 of the fuel nozzle 12. Next, as shown in FIG. 12, the fuel injectors 24 may then be removed from their location on the end cover assembly 58. As discussed above, fuel injectors 24 may be coupled to the end cover assembly 58 by various couplings, such as a brazed joint, a welded joint, bolts, or threaded joints, interference fits, wedge fits, or any combination thereof. In some embodiments, where the injector 24 is threaded into the end cover assembly 58, the injector 24 may be removed by unthreading. Removal of one or more fuel injectors 24 may enable inspection, replacement, repair, or any other purpose found in the course of manufacturing, installation and operation of the fuel nozzle 12. Installation of fuel injectors 24 is achieved by following the steps illustrated in FIGS. 10-12 in reverse order. Namely, the one or more fuel injectors 24 may be inserted (e.g., brazed or threaded) in place on the cap face assembly 60 (FIG. 12). The support structure 82 is then coupled with the end cover assembly 58 by aligning the fuel injectors 24 with their respective mixing tubes 26 (FIG. 11). The assembled fuel nozzle 12 (FIG. 12) may then be installed into the head end 56 of the combustor 12.

Technical effects of the disclosed embodiments include systems and methods for improving the mixing of the fuel 14 and the air 18 within multi-tube fuel nozzles 12 of a gas turbine system 10. In particular, the fuel nozzle 12 is equipped with multiple fuel injectors 24 each disposed within a premixing tube 26. Each fuel injector spike 24 includes fuel ports 25 through which fuel that enters the fuel nozzle 12 is directed and mixes with air entering through an air flow conditioner 28. Because the fuel spike 24 and mixing tube 26 are physically decoupled they are also thermally decoupled, allowing for simplified management of any thermal expansion that may occur during operation of the fuel nozzle 12. The fuel ports 25 may be configured with different numbers, shapes, sizes, spatial arrangements, and configured to direct the fuel at various angles. This customization increases mixing and uniformity, compensating for the varying air 18 and fuel 22 pressures among the multiple fuel injectors 24 in the multi-tube fuel nozzle 12. The increased mixing of the fuel 22 and the air 18 increases the flame stability within the combustor 16 and reduces the amount of undesirable combustion byproducts. The method of removal and replacement of individual fuel injectors 24 enables cost-effective and efficient repair of the fuel nozzle 12.

Although some typical sizes and dimensions have been provided above in the present disclosure, it should be understood that the various components of the described combustor may be scaled up or down, as well as individually adjusted for various types of combustors and various applications. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

a multi-tube fuel nozzle, comprising:

a plurality of premixing tubes, wherein each premixing tube of the plurality of premixing tubes comprises a plurality of air ports configured to receive air;

a plurality of fuel injectors, wherein each fuel injector is configured to extend into a respective premixing tube of the plurality of premixing tubes, and each fuel injector comprises:

a body wherein the body comprises a first upstream end, a first downstream end, and a tapered portion, and wherein the tapered portion tapers in a direction from the first upstream end to the first downstream end, and the body comprises an upstream portion that axially extends from the upstream end and has an outer surface that directly contacts a first inner surface of the respective premixing tube;

a fuel passage disposed within the body and comprising a second upstream end and a second downstream end, wherein the body comprises annular portion defining the fuel passage, and the fuel passage extends in a longitudinal direction within a portion of the body; and a plurality of fuel ports disposed along the portion of the body and coupled to the fuel passage, wherein a space is disposed between the portion of the body with the fuel ports and the respective premixing tube at a location downstream of the upstream portion, wherein the fuel passage ends prior to the tapered portion, and an entirety of an outlet of each fuel port of the plurality of fuel ports is disposed along the annular portion downstream of both the first upstream end and the upstream portion and upstream of the second downstream end of the fuel passage;

wherein the plurality of air ports of the respective premixing tube are located downstream of both the first upstream end and the upstream portion and upstream of the second downstream end of the fuel passage of a respective fuel injector of the plurality of fuel injectors.

2. The system of claim 1, wherein the plurality of fuel ports are disposed on the annular portion.

3. The system of claim 1, wherein at least one fuel port of the plurality of fuel ports is configured to radially inject fuel into the respective premixing tube.

4. The system of claim 1, wherein at least one fuel port of the plurality of fuel ports is configured to inject fuel at an angle relative to a longitudinal axis of the fuel injector.

5. The system of claim 4, wherein the angle is oriented axially downstream relative to the longitudinal axis.

6. The system of claim 4, wherein the angle is oriented tangentially to direct the fuel circumferentially about the longitudinal axis of the fuel injector.

7. The system of claim 1, wherein the plurality of fuel ports comprise a first fuel port disposed at a first axial position along the portion of the body and a second fuel port disposed at a second axial position along the portion of the body.

8. The system of claim 1, wherein the system comprises a combustor end cover assembly, and the plurality of fuel injectors are coupled to the combustor end cover assembly.

9. The system of claim 1, wherein the system comprises a gas turbine engine or a combustor having the multi-tube fuel nozzle.

10. The system of claim 1, wherein the fuel passage of the fuel injector comprises a first diameter between a second inner surface of the annular portion that is greater than a second diameter of a downstream end of the fuel injector.

11. A system, comprising:

a combustor end cover assembly; and a multi-tube fuel nozzle, comprising:

a plurality of premixing tubes, wherein each premixing tube of the plurality of premixing tubes comprises a plurality of air ports configured to receive air;

a plurality of fuel injectors coupled to the combustor end cover assembly, wherein each fuel injector is configured to extend into a respective premixing tube of the plurality of premixing tubes, and each fuel injector comprises:

an annular portion;

a tapered portion downstream of the annular portion;

an upstream end;

an upstream portion that axially extends from the upstream end and has an outer surface that directly contacts a first inner surface of the respective premixing tube;

a space disposed between a portion of the annular portion with a plurality of fuel ports and the respective premixing tube at a location downstream of the upstream portion;

a first downstream end, wherein the tapered portion tapers in a direction from the upstream end to the first downstream end;

a fuel passage extending through the annular portion; and the plurality of fuel ports coupled to the fuel passage, wherein the fuel passage ends prior to the tapered portion, and wherein an entirety of an outlet of each fuel port of the plurality of fuel ports is disposed along the annular portion downstream of both the upstream end and the upstream portion and upstream of a second downstream end of the fuel passage;

wherein the plurality of air ports of the respective premixing tube are located downstream of both the first upstream end and the upstream portion and upstream of the second downstream end of the fuel passage of a respective fuel injector of the plurality of fuel injectors.

12. The system of claim 11, wherein each fuel injector of the plurality of fuel injectors is configured to be individually removed from or installed on the combustor end cover assembly.

13. The system of claim 11, wherein the fuel passage of each fuel injector of the plurality of fuel injectors comprises a first diameter between a second inner surface of the annular portion that is greater than a second diameter of the second downstream end.

14. A system, comprising:

a combustor end cover assembly; and a multi-tube fuel nozzle, comprising:

a premixing tube having a plurality of air ports configured to receive air into the premixing tube;

a fuel injector coupled to the combustor end cover assembly, wherein the fuel injector extends into the premixing tube, and the fuel injector comprises:

an annular portion;

a tapered portion downstream of the annular portion;

an upstream end;

an upstream portion that axially extends from the upstream end and has an outer surface that directly contacts a first inner surface of the premixing tube;

a space disposed between a portion of the annular portion with a plurality of fuel ports and the premixing tube at a location downstream of the upstream portion;

a fuel passage extending through the annular portion; and a plurality of fuel ports coupled to the fuel passage, wherein the fuel passage end prior to the tapered portion, wherein the plurality of fuel ports is disposed in the annular portion, and wherein an entirety of each fuel port of the plurality of fuel ports is disposed along the annular portion downstream of both the upstream end and the upstream portion and upstream of a downstream end of the fuel passage;

wherein each air port of the plurality of air ports is disposed only axially downstream of both the first upstream end and the upstream portion and upstream of each fuel port of the plurality of fuel ports and the downstream end of the fuel passage.

* * * * *